US011571021B2

(12) United States Patent
Smith et al.

(10) Patent No.: US 11,571,021 B2
(45) Date of Patent: Feb. 7, 2023

(54) UTILITY CONTAINER FOR HERBAL PRODUCTS

(71) Applicant: Trippy Kit LLC., Cockeysville, MD (US)

(72) Inventors: Christopher P. Smith, Los Angeles, CA (US); Casey Smith, Los Angeles, CA (US); Frank Coleman, Cockeysville, MD (US)

(73) Assignee: Trippy Kit LLC, Cockeysville, MD (US)

( * ) Notice: Subject to any disclaimer, the term of this patent is extended or adjusted under 35 U.S.C. 154(b) by 99 days.

(21) Appl. No.: 17/245,868

(22) Filed: Apr. 30, 2021

(65) Prior Publication Data

US 2022/0346442 A1 Nov. 3, 2022

(51) Int. Cl.
*A24F 23/00* (2006.01)
*A24B 7/06* (2006.01)
*A24F 19/10* (2006.01)

(52) U.S. Cl.
CPC ..... *A24F 23/00* (2013.01); *A24B 7/06* (2013.01); *A24F 19/10* (2013.01)

(58) Field of Classification Search
CPC .... A24F 23/00; A24F 5/10; A24F 9/00; A24F 19/10; A47J 42/24; A47J 42/12; A24B 7/06
USPC ..... 131/329, 250, 281; 206/236, 242, 86
See application file for complete search history.

(56) References Cited

U.S. PATENT DOCUMENTS 8,083,167 B1 12/2011 Namakian et al.
9,717,272 B2 * 8/2017 Patel ..... B65D 81/26
10,015,985 B1 7/2018 Blakely, III
10,471,223 B2 11/2019 Bourque
10,492,524 B2 12/2019 Ruzycky
10,694,894 B1 6/2020 Ashton
2016/0081390 A1 * 3/2016 Ackerman ..... A24F 47/00 206/86
2017/0332697 A1 * 11/2017 Roberto, Jr. ..... A24B 7/06
(Continued)

OTHER PUBLICATIONS

Unknown, "Large Stash Box 100% Bamboo—Smell Proof—Sliding Rolling Tray w/Brush—3 Airtight Containers—Herb Grinder—Handcrafted/Natural Varnished Color" Sold on Amazon, https://www.amazon.com/Large-Stash-Box-100-Bamboo/dp/B088HC28LH/ (Last Accessed Apr. 30, 2021, 9 pages).

*Primary Examiner* — King M Chu
(74) *Attorney, Agent, or Firm* — Darrow Mustafa PC

(57) ABSTRACT

Discloses embodiments relate to a container assembly for storing herbal products and accessories. The assembly includes a housing, including a grinder compartment that includes a perforated base with frame walls surrounding the perforated base, a first side opening beneath the perforated base, and a second side opening. The assembly further includes a slidable tray configured to slide into and out of the first side opening, a perforated grinder bottom configured to fit within the frame walls of the grinder compartment, a grinder top configured to fit within the frame walls of the grinder compartment and including a plurality of grinding teeth protruding from a first surface and a receptacle structure on a second surface opposite the first surface, and a leverage device configured to slide into and out of the second side opening and including an engaging structure configured to fit into the receptacle structure of the grinder top.

12 Claims, 9 Drawing Sheets

(56) References Cited

U.S. PATENT DOCUMENTS

| | | | |
|---|---|---|---|
| 2018/0338642 | A1 | 11/2018 | Staiano et al. |
| 2019/0125132 | A1 | 5/2019 | Powers et al. |
| 2020/0214342 | A1 | 7/2020 | Greenman |

* cited by examiner

100

400

300

300

UTILITY CONTAINER FOR HERBAL PRODUCTS

TECHNICAL FIELD

The subject matter described herein relates generally to herbal accessories and, in particular to a compact utility container for storing and preparing herbal products for use and/or consumption by inhalation.

BACKGROUND

Herbal consumption by inhalation is becoming more prevalent as various jurisdictions approve the use of medicinal and recreational herbs, such as marijuana. To prepare such herbs for consumption, an individual must take a number of steps including grinding, sifting, packing, etc., that can best be accomplished with the aid of a variety of tools. Such tools may not be readily available to an individual who is away from home or otherwise traveling.

SUMMARY

Embodiments described herein disclose a container assembly designed to easily store and transport herbal product and multiple tools used in preparing the herbal product for consumption by inhalation.

For example, in one embodiment a container assembly includes a housing including a grinder compartment that includes a perforated base with frame walls surrounding the perforated base, a first side opening beneath the perforated base, and a second side opening. The housing further includes a slidable tray configured to slide into and out of the first side opening, a perforated grinder bottom configured to fit within the frame walls of the grinder compartment, a grinder top configured to fit within the frame walls of the grinder compartment and including a plurality of grinding teeth protruding from a first surface and a receptacle structure on a second surface opposite the first surface, and a leverage device configured to slide into and out of the second side opening and including an engaging structure configured to fit into the receptacle structure of the grinder top.

BRIEF DESCRIPTION OF THE DRAWINGS

The accompanying drawings, which are incorporated in and constitute a part of the specification, illustrate various embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

This detailed description relates to a utility container assembly for storing and transporting herbal products and associated tool/accessories used for preparing the herbal product for consumption by inhalation. Detailed embodiments are disclosed herein, however, it is to be understood that the disclosed embodiments are intended only as examples. Specific structural and functional details disclosed herein are not to be interpreted as limiting, but merely as a basis for the claims and as a representative basis for teaching one skilled in the art to variously employ the features described herein in virtually any appropriately detailed structure. Further, the terms and phrases used herein are not intended to be limiting but rather to provide an understandable description of possible implementations.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, components, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

To provide a useful, compact device that can store and transport herbal products and related accessories for aiding in preparation of the herbal product for consumption by inhalation, a utility container assembly is disclosed.

Figure 1:
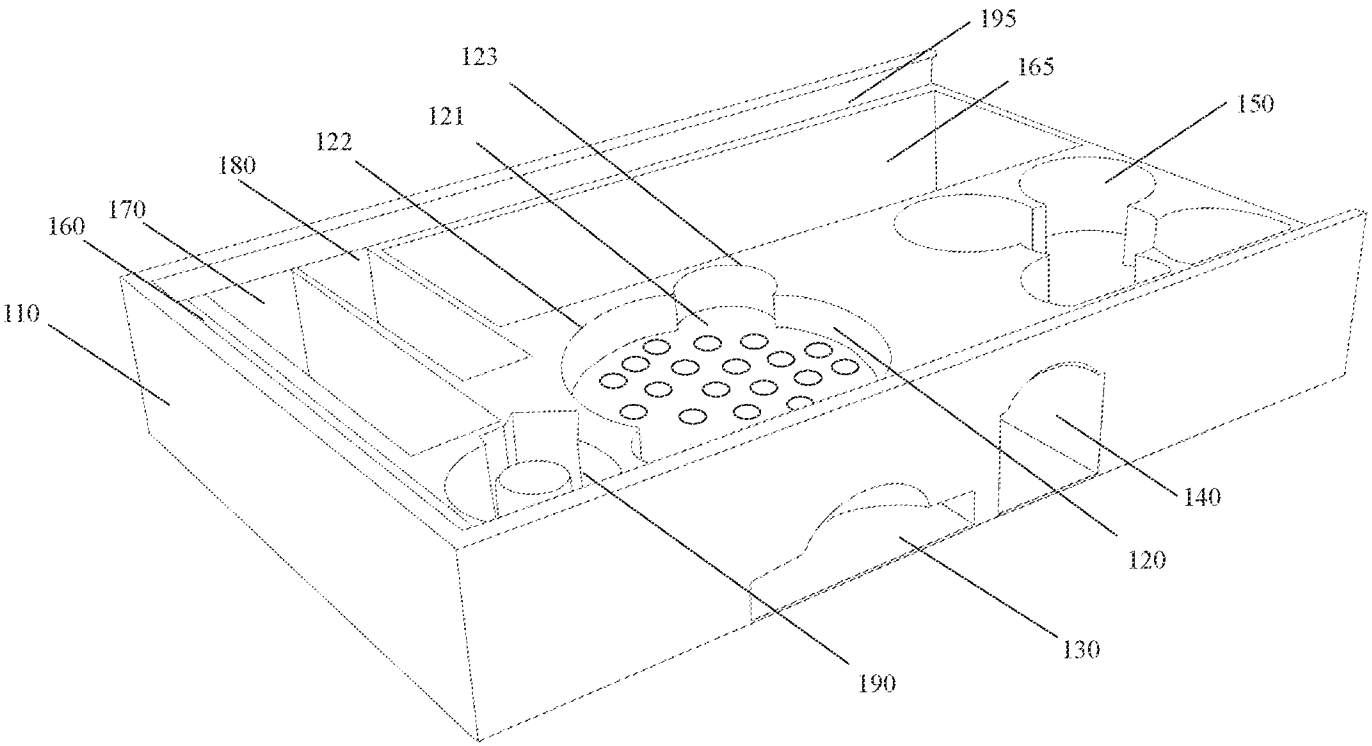
FIG. 1 illustrates a perspective view of a container assembly according to the disclosed subject matter.

FIG. 1 shows a perspective view of a container assembly 100 with the lid (not shown) removed, according to the disclosed embodiments. The container assembly includes a housing 110, a grinder compartment 120, a first side opening 130 beneath the grinder compartment 120, and a second side opening 140. In one or more embodiments, the housing 110 can include one or more compartments for storing accessories, such as a plurality of canister compartments 150 configured to hold containers that can store herbs, a tool compartment 160 configured to store tools (e.g., tweezer, poker, scoop, etc.), a large compartment 165 to store miscellaneous preparation related products (e.g., paper, filters, cigars, etc.) a lighter compartment 170 configured to store a lighter, an eye drop compartment 180 configured to store mini eye drops, and a holder compartment 190 configure to store a cigar ring.

In one or more embodiments, the compartments 150-190 can be positioned in an arrangement different from the arrangement shown in FIG. 1.

In one or more embodiments, the housing 110 can further include one or more grooves 195 configured to receive a lid (e.g., the lid shown in FIG. 13-14), as will be discussed further below.

In one or more embodiments, the grinder compartment 120 can include a perforated base 121 with frame walls 122 surrounding the perforated base 121. The perforations of the perforated base 121 can be formed of an appropriate size for sifting grounded herbal products, as will be discussed further below. The frame walls 122 can include one or more indentations 123 to mechanically engage a grinder bottom and obstruct rotational movement, as will be discussed further below.

Figure 2:
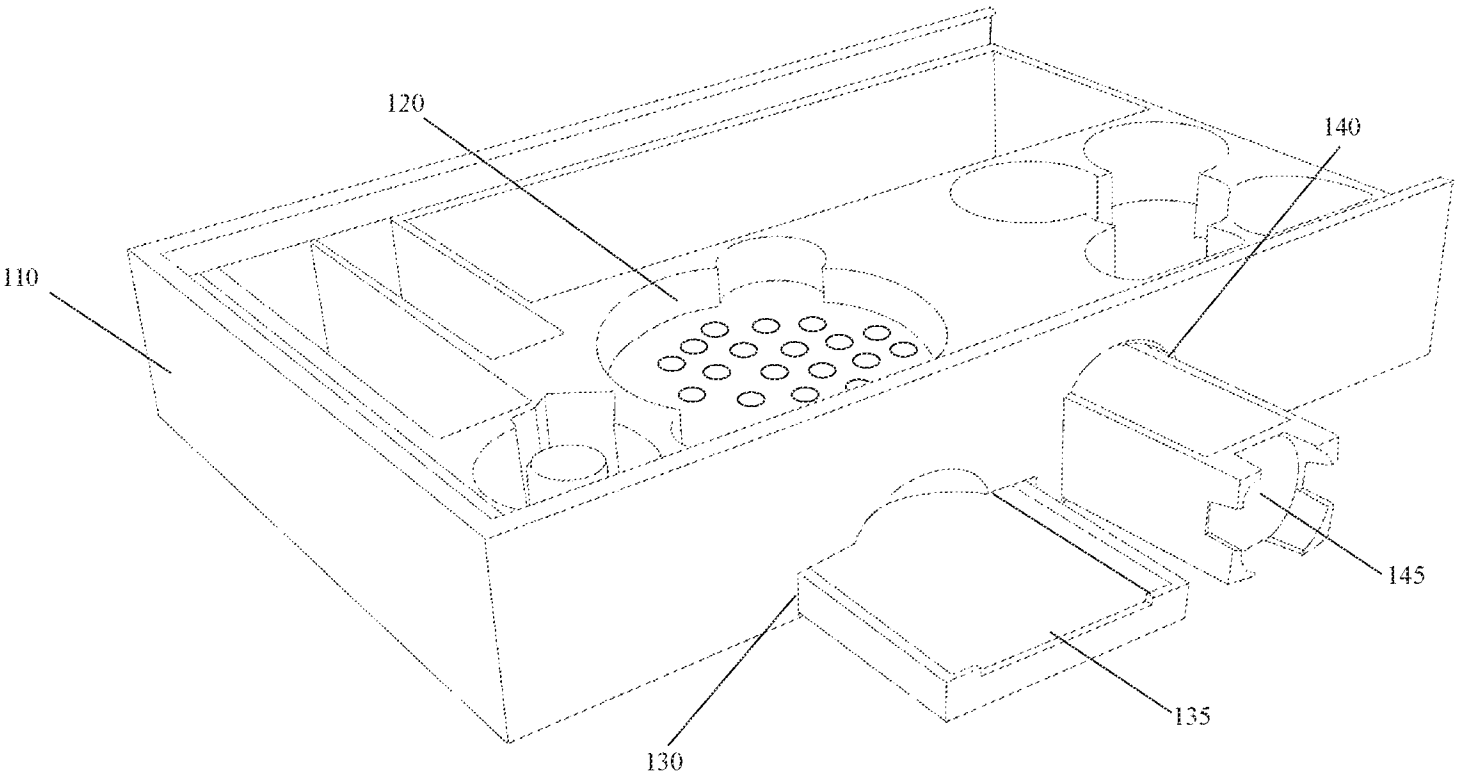
FIG. 2 illustrates a container assembly with a slidable tray partially inserted into a first side opening and a leverage device partially inserted into a second side opening, according to the disclosed embodiments.

FIG. 2 shows the housing 110 with a slidable tray 135 partially inserted into the first side opening 130, and a leverage device 145 partially inserted into the second side opening 140. In one or more embodiments, the first side opening 130 is defined by a cavity within the housing 110 having sufficient size and shape as to permit the housing 110 to completely store the slidable tray 135 beneath the grinder compartment 120. The second side opening 140 can be defined by a second cavity within the housing 110 having sufficient size and shape as to permit the housing 110 to completely store the leverage device 145 within the second side opening 140.

Figure 3:
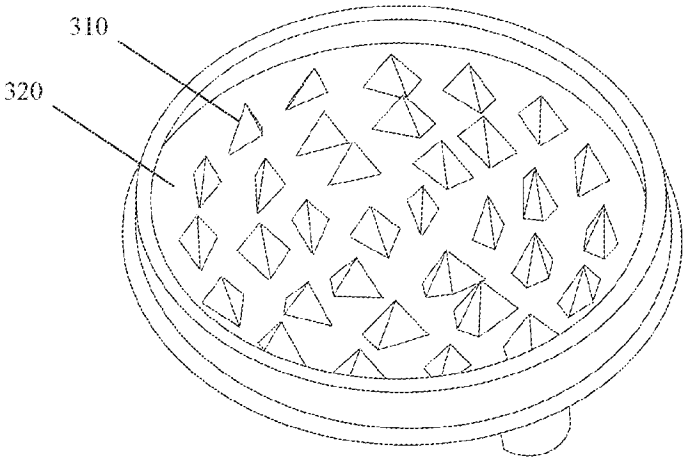
FIG. 3 illustrates a perspective bottom view of a grinder top, according to the disclosed embodiments.

FIG. 3 shows a perspective bottom view of a grinder top 300 according to one or more embodiments of the disclosed subject matter. The grinder top 300 includes an array of teeth 310 protruding away from a surface 320 of the grinder top 300.

Figure 4:
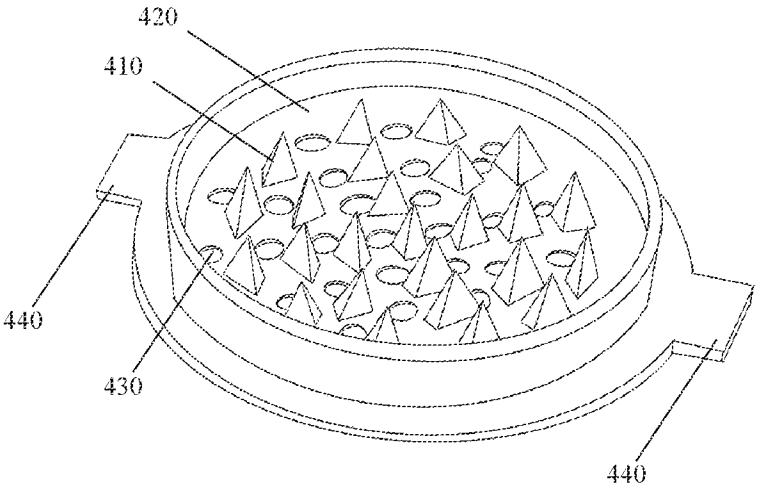
FIG. 4 illustrates a perspective top view of a grinder bottom, according to the disclosed embodiments.

FIG. 4 shows a perspective top view of a grinder bottom 400 according to one or more embodiments of the disclosed subject matter. The grinder bottom 400 includes an array of teeth 410 protruding away from a surface 420 of the grinder bottom 400. The grinder bottom 400 also includes a plurality of perforations 430 disposed in the surface 420. In one or more embodiments, the grinder bottom 400 further includes one or more protrusions 440 configured to mechanically engage with one or more indentations 123 (FIG. 1) of the grinder compartment 120 (FIG. 1).

Figure 5:
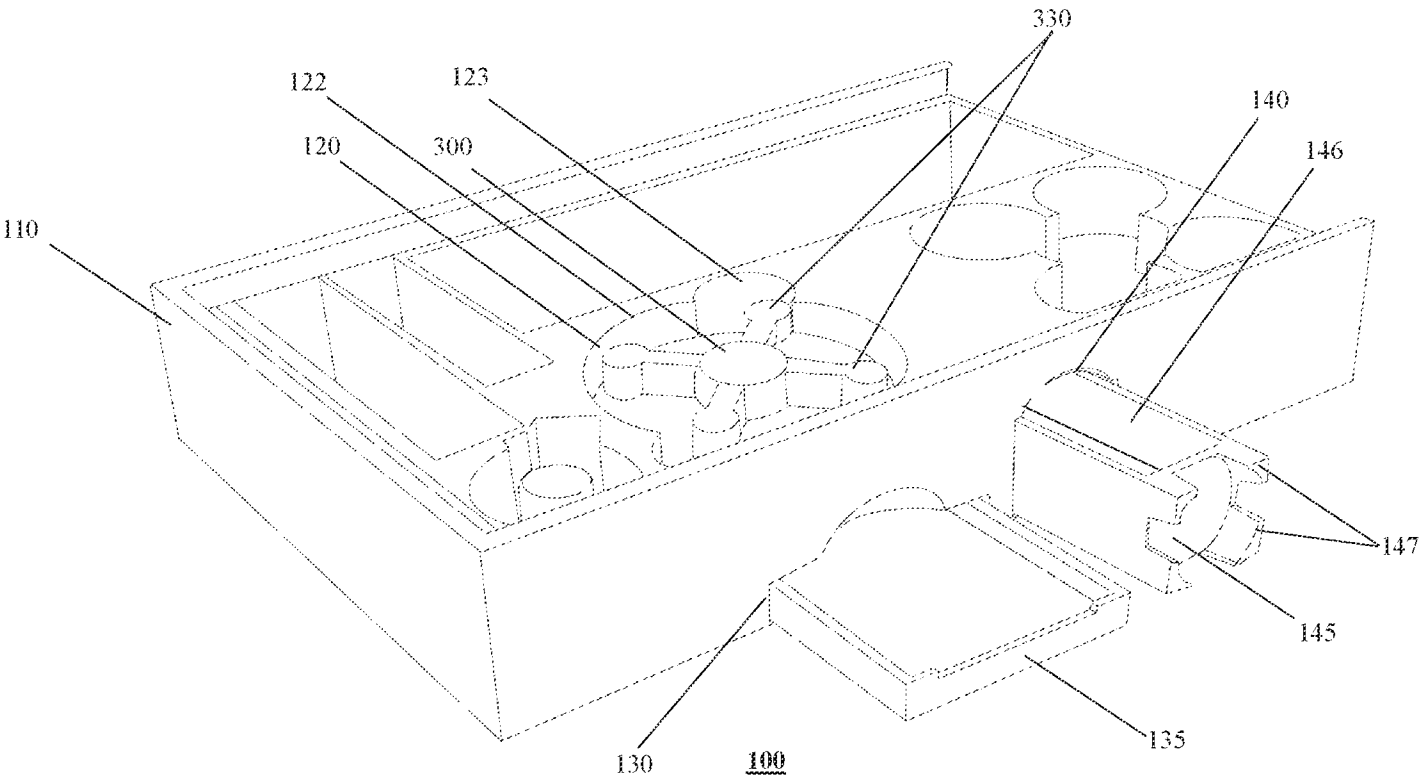
FIG. 5 illustrates a perspective view of the housing with the grinder top and grinder bottom installed within the grinder compartment, according to the disclosed subject matter.

FIG. 5 shows a perspective view of the housing 110 with the grinder top 300 and grinder bottom 400 (not visible) installed within the grinder compartment 120. When the grinder top 300 and grinder bottom 400 are installed in the grinder compartment 120, their respective arrays of teeth 310, 410, (not visible) face each other. In one or more embodiments, the arrays of teeth 310, 410 are arranged to pass between one another when a rotating force is applied to the grinder top 300. The grinder bottom 400 remains static and does not rotate as it is mechanically held in place by the engagement of the protrusions 440 (FIG. 4) with the indentations 123 of the frame wall 122 in the grinder compartment 120.

Herbal products placed between the grinder top 300 and grinder bottom 400 are ground into smaller particles when a user rotates the grinder top 300. When the herbal particles are grounded small enough, they fall through the perforations 430 (FIG. 4) in the grinder bottom, through the perforated base 121 (FIG. 1) of the grinder compartment 120, and drop into the slidable tray 135. The user may pull the slidable tray out of the first side opening 130 and retrieve the grounded herbal product for further preparation and use.

In one or more embodiments, the container assembly 100 includes a leverage device 145 that a user can use to gain increased leverage and more easily grind the herbal product. The leverage device 145 can slide into the second side opening 140 for storage and easily be pulled out when needed for use. In one or more embodiments, the leverage device 145 can further include a longitudinal cavity 146 that can allow the leverage device 145 to serve a dual function as an ash tray.

The leverage device 145 includes an engaging structure 147 configured to mechanically engage a receptacle structure 330 disposed on a top surface of the grinder top 300. In one or more embodiments, the engaging structure 147 is implemented as a protruding pattern configured to mechanically interlock with or fit within a corresponding pattern of protrusions or grooves that comprise the receptacle structure 330. For example, in one or more embodiments, the engaging structure 147 can be implemented as a plurality of rods or protrusions disposed in a pattern configured to fit within a matching pattern holes or openings of the receptacle structure 330.

Figure 6:
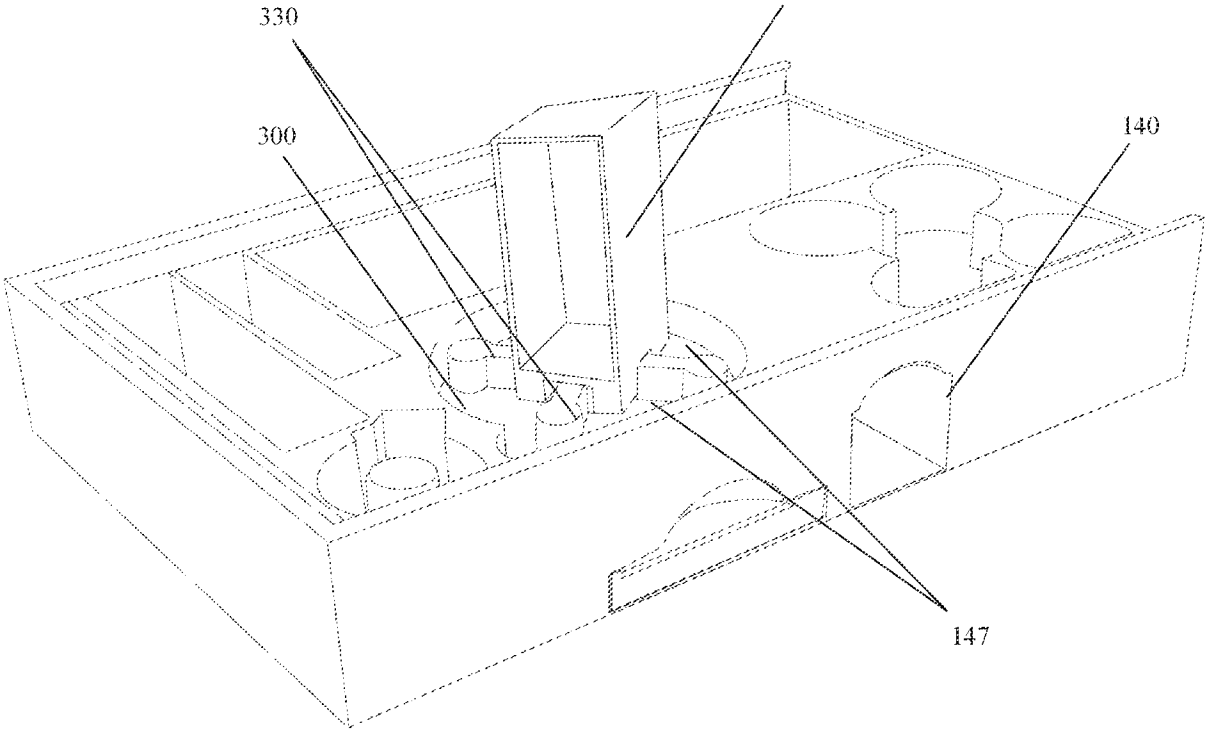
FIG. 6 illustrates the leverage device removed from the second side opening and placed in position to provide a user with leverage to rotate the grinder top, according to the disclosed subject matter.

FIG. 6 shows the leverage device 145 removed from the second side opening 140 and placed in position to provide the user with leverage to rotate the grinder top 300. As shown, the engaging structure 147 locks into place with the receptacle structure 330 relative to rotational movement of the leverage device 145 and grinder top 300. Thus, when the leverage device 145 is in the engaged position the user can easily rotate the grinder top 300 back and forth for grinding purposes by simply rotating the leverage device 145.

Figure 7:
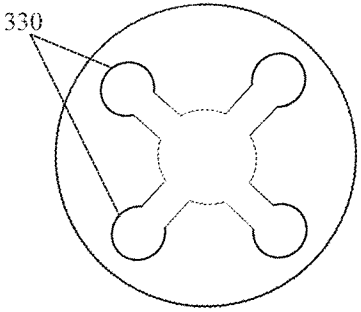
FIG. 7 illustrates a top view of an example grinder top, according to the disclosed subject matter.

FIG. 7 shows a top view of an example grinder top 300 and shows an example pattern of the receptacle structure 330. This pattern of the receptacle structure 330 is merely one example pattern. One of ordinary skill in the art will recognize that different patterns may be used to implement the receptacle structure 330, provided the pattern corresponds to and engages the pattern of the engaging structure 147 (e.g., FIG. 5) of the leverage device 145.

Figure 8:
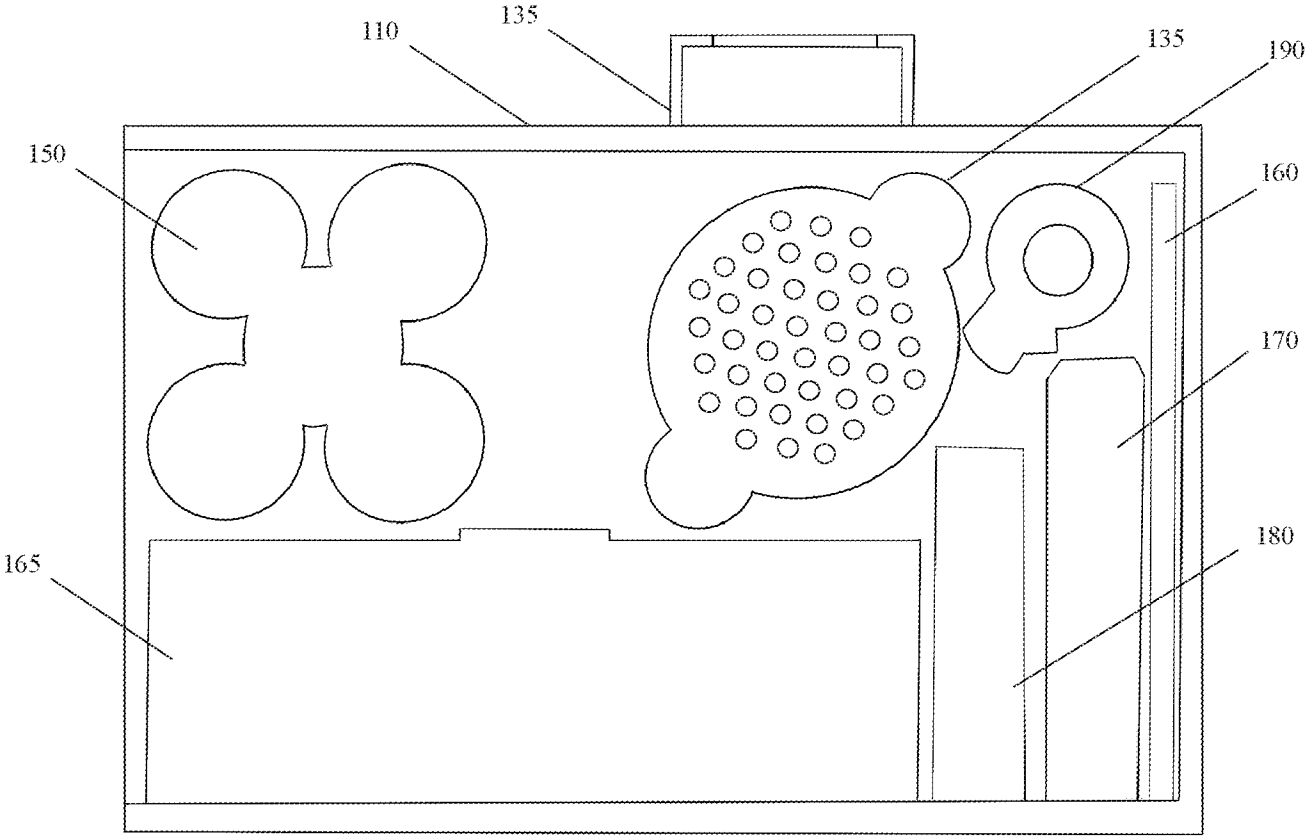
FIG. 8 illustrates a top view of the housing, according to the disclosed subject matter.

FIG. 8 shows a top view of the housing 110 with a top view of the grinder compartment 120, canister compartments 150, tool compartment 160, large compartment 165, lighter compartment 170, eye drop compartment 180, and holder compartment 190. The slidable tray 135 is also visible, partially slid out.

FIGS. 9-12 show example tools and accessories that may be stored in the compartments 150-190.

Figure 9:
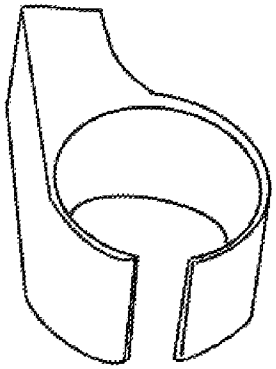
FIG. 9 illustrates an example cigar holder, according to the disclosed subject matter.

FIG. 9 shows an example cigar holder 191 that may be stored in the holder compartment 190. In one or more embodiments the cigar holder 191 can be implemented as a flexible finger ring that can assist a user in holding rolled products for consumption by inhalation.

Figure 10:
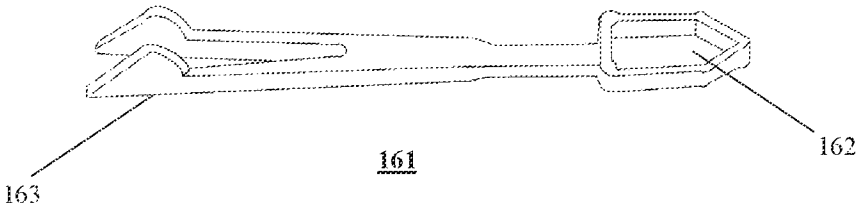
FIG. 10 illustrates example tweezers, according to the disclosed subject matter.

FIG. 10 shows an example tweezers 161 that may be stored in the tool compartment 160. In one or more embodiments, the tweezers 161 can be a two-ended tool that has a scoop 162 on one end and tweezer pincers 163 on the other end.

Figure 11:
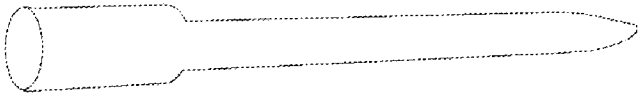
FIG. 11 illustrates an example poker, according to the disclosed subject matter.

FIG. 11 shows an example poker 164 that may also be stored in the tool compartment 160. In one or more embodiments, the poker 164 can be implemented as a two-ended tool that is flat on one end and pointed on the other end.

Figure 12:
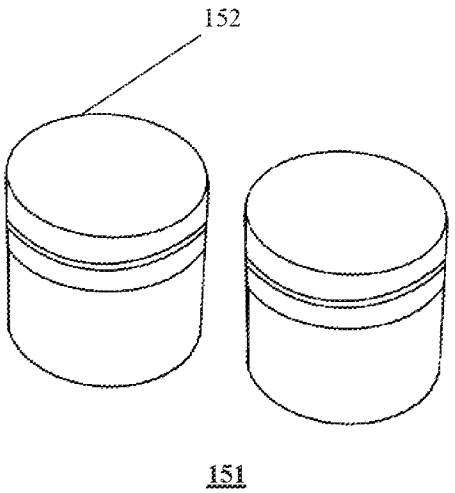
FIG. 12 illustrates example of herbal storage containers, according to the disclosed subject matter.

FIG. 12 shows example of herbal storage containers 151 that can be stored in the canister compartments 150. In one or more embodiments, the containers 151 can include a screw-on top 152. In one or more embodiments the housing can include a plurality of canister compartments, such as at four or five, to store a plurality of containers 151. The containers 151 can be implemented in any common container-like configuration, for example, in any of various shapes or sizes.

Figure 13:
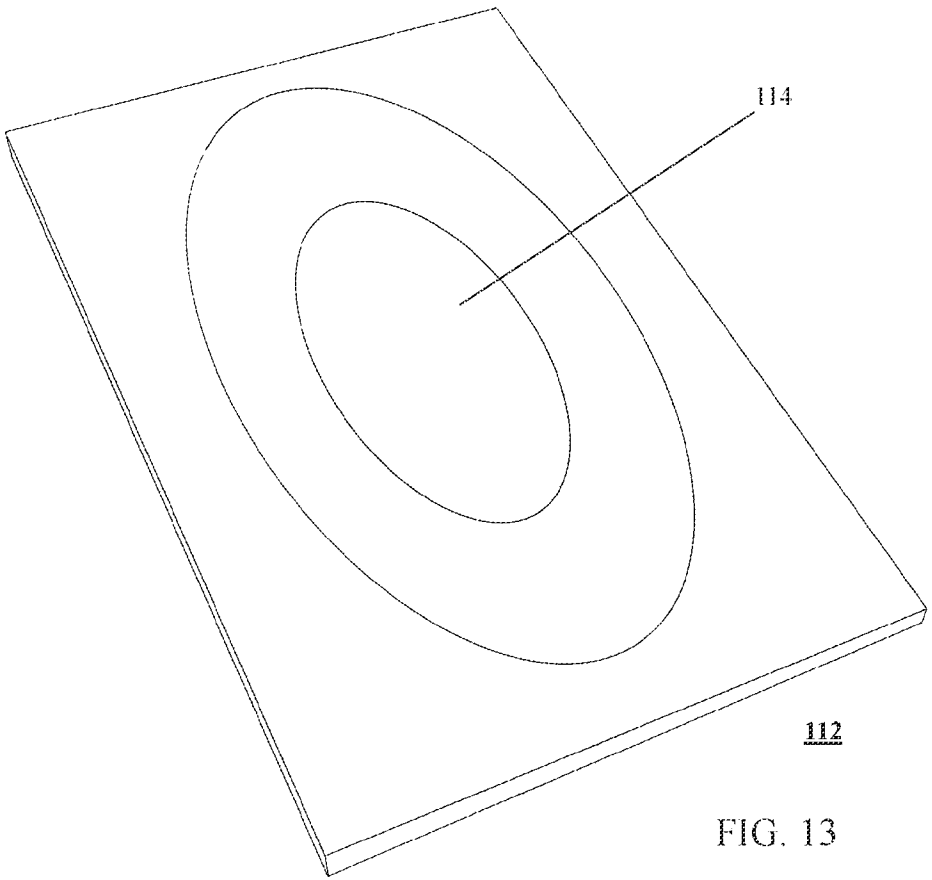
FIG. 13 illustrates a perspective view of a lid for the housing, according to the disclosed subject matter.
Figure 14:
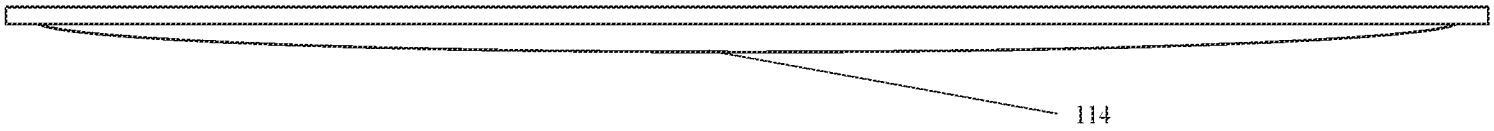
FIG. 14 illustrates a side view of the lid for the housing, according to the disclosed subject matter.

FIG. 13 shows a perspective view of a lid 112 for the housing 110 (FIG. 1). The lid 112 can be constructed having a thickness that allows the lid 112 slide into grooves 195 (FIG. 1) disposed in the housing such that the lid 112 covers the interior of the housing, i.e., covers the grinder compartment 120, canister compartments 150, tool compartment 160, large compartment 165, lighter compartment 170, eye drop compartment 180, and holder compartment 190. In one or more embodiments, the lid 112 is flat. In one or more embodiments, the lid 112 has a concave central region 114. For example, the lid 112 can be implemented slightly concave on one side to act as an assistance tray to help the user prepare the herbal products for consumption. FIG. 14 shows a side view of the lid 112 having a slightly concave central region 114.

Accordingly, the disclosed container assembly 100 can conveniently and compactly store herbal products and multiple accessories related to preparing herbal products for consumption. Furthermore, the disclosed container assembly 100 can include built-in mechanisms for preparation related tasks, such as grinding the herbal products.

Aspects of the subject matter disclosed herein can be embodied in other forms, configurations and arrangements without departing from the spirit or essential attributes thereof. Accordingly, reference should be made to the following claims, rather than to the foregoing specification, as indicating the scope hereof.

What is claimed is:

1. A container assembly for storing and preparing herbal products, comprising:

a housing, including:

a grinder compartment that includes a perforated base with frame walls surrounding the perforated base, a first side opening beneath the perforated base, and a second side opening;

a slidable tray configured to slide into and out of the first side opening, a perforated grinder bottom configured to fit within the frame walls of the grinder compartment;

a grinder top configured to fit within the frame walls of the grinder compartment and including a plurality of grinding teeth protruding from a first surface and a receptacle structure on a second surface opposite the first surface; and a leverage device configured to slide into and out of the second side opening and including an engaging structure configured to fit into the receptacle structure of the grinder top.

2. The container assembly of claim 1, further comprising a concave lid configured to slide into grooves on the housing to cover the grinder compartment.

3. The container assembly of claim 1, wherein the leverage device includes an ash tray defined by a longitudinal cavity.

4. The container assembly of claim 1, wherein the engaging structure comprises a protruding pattern configured to interlock with a corresponding protrusion pattern of the receptacle structure.

5. The container assembly of claim 1, wherein the frame walls include one or more indentations and the grinder bottom includes one or more protrusions configured to fit within the one or more indentations and thereby prevent rotational movement of the grinder bottom.

6. The container assembly of claim 1, wherein the housing further includes a plurality of compartments configured to hold a plurality of containers that can store herbs.

7. The container assembly of claim 1, wherein the housing further includes a compartment configured to store a poker tool.

8. The container assembly of claim 1, wherein the housing further includes a compartment configured to store a tweezer tool.

9. The container assembly of claim 1, wherein the housing further includes a compartment configured to store a lighter.

10. The container assembly of claim 1, wherein the housing further includes a compartment configured to store a cigar ring.

11. A container assembly for storing and preparing herbal products, comprising:

a housing, including:

a grinder compartment that includes a perforated base with frame walls surrounding the perforated base, a first side opening beneath the perforated base, a second side opening, a plurality of container compartments configured to hold a plurality of containers that can store herbs, a plurality of tool compartments configured to hold at least a tweezer tool, a poker tool, and a lighter;

a slidable tray configured to slide into and out of the first side opening, a perforated grinder bottom configured to fit within the frame walls of the grinder compartment;

a grinder top configured to fit within the frame walls of the grinder compartment and including a plurality of grinding teeth protruding from a first surface and a receptacle structure on a second surface opposite the first surface;

a leverage device configured to slide into and out of the second side opening and including an engaging structure configured to fit into the receptacle structure of the grinder top; and a concave lid configured to slide into grooves on the housing to cover the grinder compartment, container compartments, and tool compartments.

12. The container assembly of claim 11, wherein the leverage device includes an ash tray defined by a longitudinal cavity.

* * * * *